US007467759B2

(12) United States Patent
Brown

(10) Patent No.: US 7,467,759 B2
(45) Date of Patent: Dec. 23, 2008

(54) ADJUSTMENT MECHANISM FOR A WIRE TENSIONING APPARATUS

(76) Inventor: Maurice H. Brown, 502 W. Main St., Albion, NE (US) 68620

( * ) Notice: Subject to any disclaimer, the term of this patent is extended or adjusted under 35 U.S.C. 154(b) by 509 days.

(21) Appl. No.: 11/224,859

(22) Filed: Sep. 13, 2005

(65) Prior Publication Data

US 2007/0057108 A1 Mar. 15, 2007

(51) Int. Cl.

| | |
|---|---|
| ***B65H 59/16*** | (2006.01) |
| ***F16H 25/10*** | (2006.01) |
| ***F16H 53/06*** | (2006.01) |
| ***H02P 31/00*** | (2006.01) |

(52) U.S. Cl. ..... 242/419.1; 74/55; 74/569; 242/419.9; 318/467

(58) Field of Classification Search ..... 242/419, 242/419.1, 419.8, 419.9, 421.8, 421.9, 129.8, 242/147 R, 148, 155 R, 155 BW, 156, 156.2; 74/55, 89, 99 R, 504, 567, 569; 66/213, 66/146; 139/194, 200; 28/194; 318/281, 318/284, 443, 467; 188/166, 171, 2 D, 196 B, 188/196 BA, 196 V See application file for complete search history.

(56) References Cited

U.S. PATENT DOCUMENTS

| | | | | | |
|---|---|---|---|---|---|
| 45,230 | A | * | 11/1864 | Dean | 74/55 |
| 1,966,336 | A | * | 7/1934 | Dewey | 200/61.58 R |
| 1,982,603 | A | * | 11/1934 | Barbarou | 74/55 |
| 2,819,736 | A | * | 1/1958 | Pfarrwaller | 139/194 |
| 3,199,359 | A | * | 8/1965 | Beezer | 74/55 |
| 3,520,492 | A | | 7/1970 | Brown | |
| 3,597,940 | A | * | 8/1971 | Dupuis | 66/213 |
| 3,635,052 | A | * | 1/1972 | Monney | 66/146 |
| 3,837,598 | A | | 9/1974 | Brown | |
| 3,990,652 | A | | 11/1976 | Brown | |
| 4,186,897 | A | | 2/1980 | Brown | |
| 4,459,945 | A | * | 7/1984 | Chatfield | 123/55.3 |
| 4,556,832 | A | * | 12/1985 | Rollins | 318/467 |
| 5,035,369 | A | * | 7/1991 | Beran et al. | 242/486.1 |
| 5,040,741 | A | | 8/1991 | Brown | |
| 5,249,472 | A | | 10/1993 | Brown | |
| 5,357,239 | A | * | 10/1994 | Lamparter | 340/433 |
| 6,409,116 | B1 | | 6/2002 | Brown | |

* cited by examiner

*Primary Examiner*—Peter M Cuomo
*Assistant Examiner*—Scott Haugland
(74) *Attorney, Agent, or Firm*—Cook Alex Ltd.

(57) ABSTRACT

An adjustment mechanism for a wire tensioning apparatus of the type in which tension on the wire is varied by linear movement of an adjustment rod. The adjustment mechanism includes a cam shaft having a number of cams mounted on the cam shaft along the length thereof. Each cam has a lobe with the lobes positioned circumferentially around the cam shaft relative to one another. A guide plate is attached to the adjustment rod so that it is slidable diametrically relative to the cam shaft. A cam follower plate is mounted on the guide plate. A number of cam followers are carried by the cam follower plate with each cam follower aligned with one of the cams and engageable with its cam. An electric motor with a reduction gear is provided to rotate the cam shaft sequentially to move a cam in and out of engagement with its cam follower.

15 Claims, 4 Drawing Sheets

ADJUSTMENT MECHANISM FOR A WIRE TENSIONING APPARATUS

BACKGROUND OF THE INVENTION

Wire tensioning apparatuses for machines that wind fine electrical wires on electrical and electronic components such as transformers, coils, etc., receive wire which unreels over an end of a stationary reel of wire. These wire tensioning apparatuses are in widespread use throughout the world. A typical such apparatus is adjustable to vary the tension applied to the unreeling wire and provides a continuous reading of the tension applied to the wire as it uncoils. What has become the industry standard wire tensioning apparatus is shown in U.S. Pat. No. 3,837,598, issued Sep. 24, 1974, the disclosure of which is incorporated herein by reference. Such a wire tensioning apparatus many times includes an anti-slip means of the type shown in U.S. Pat. No. 3,520,492, issued Jul. 14, 1970, the disclosure of which is also incorporated herein by reference.

The conventional wire tensioning apparatus has to be shut down in order to adjust tension on the wire. Such shut downs result in the loss of production and particularly are a problem during the winding of fine wire at high speeds where different tensions are required during acceleration and deceleration of the winding process. Attempts have been made to provide electronic controlled devices for adjusting the tension of the wire during the phases of the winding process, but these electronic controlled devices are expensive and thus economically unsuitable for most wire tensioning applications.

SUMMARY OF THE INVENTION

This invention is directed to an adjustment mechanism for a wire tensioning apparatus in which the tension applied to a wire is varied by linear movement of an adjustment rod which in turn rotates a brake band operating arm.

An object of this invention is an adjustment mechanism for a wire tensioning apparatus which can adjust tension on the wire being wound without shutting down the winding operation.

Another object of this invention is an adjustment mechanism for a wire tensioning apparatus which is simpler and less expensive than electronic controlled tension adjustment devices.

Yet another object of this invention is an adjustment mechanism for a wire tensioning apparatus which is embodied in an electromechanical apparatus.

Still another object of this invention is an adjustment mechanism for a wire tensioning apparatus which provides a plurality of preset adjustments for the tension, each of which can be more finely adjusted.

An additional object of this invention is an adjustment mechanism for a wire tensioning apparatus which can be installed on existing wire tensioning apparatus with minimum modifications.

Other objects and advantages of the invention will be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

The wire tensioning adjustment mechanism 11 of this invention is adapted for use with a wire tensioning apparatus in which tension is adjusted by linear movement of a rod. The most widely used wire tensioning apparatus of this type is sold by Azonic Products, Inc. of Albion, Nebr., under the designation 3000 Series and bearing Model Nos. including 30-40G, 30-350G and 30-700G among other designations. For purposes of illustration, the wire tensioning apparatus with which the adjustment mechanism of this invention is used is that shown in U.S. Pat. No. 3,837,598, issued Sep. 24, 1974. Reference should be made to this patent for a detailed explanation of the construction and method of operation of such wire tensioning apparatuses.

Figure 1:
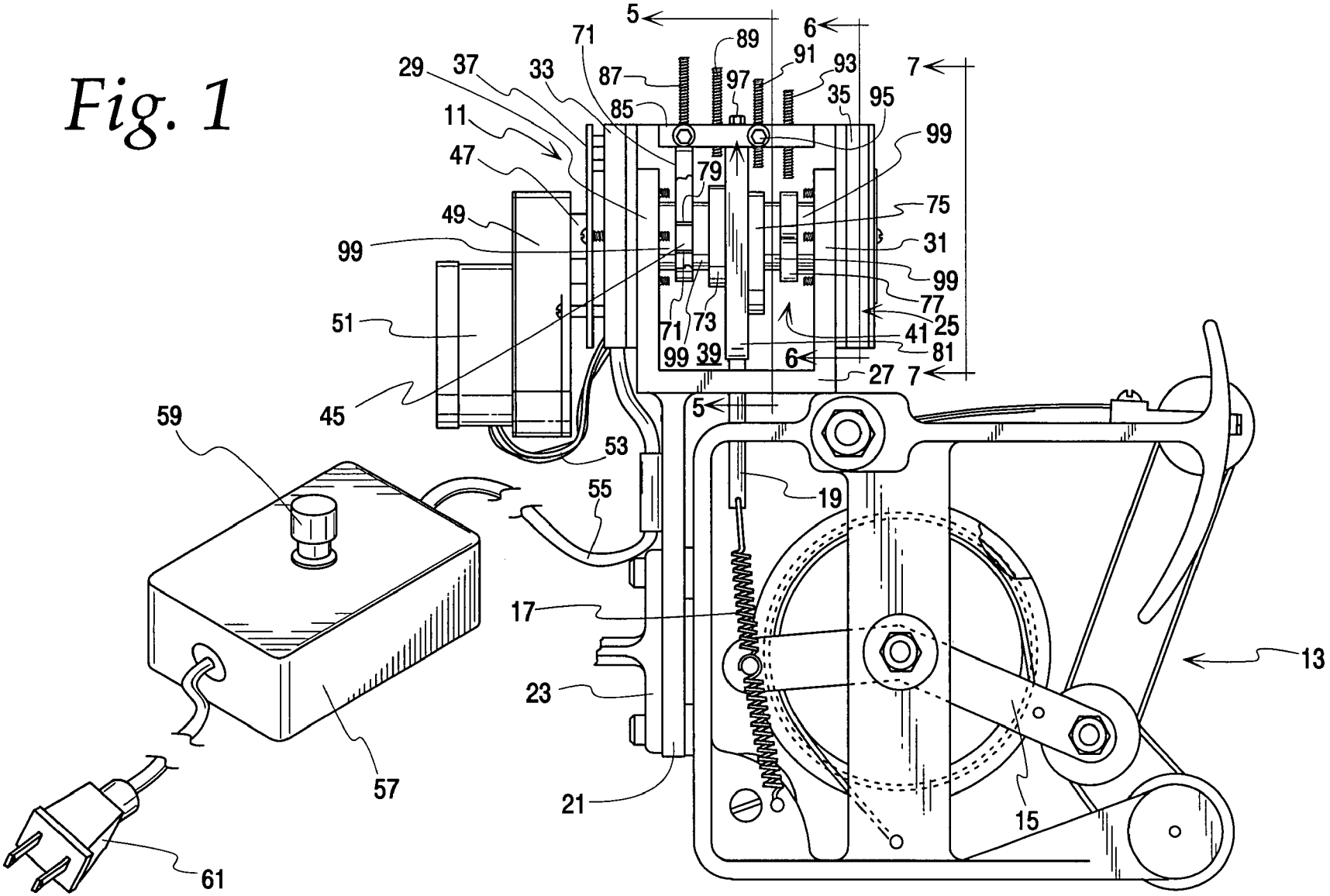
FIG. 1 is a side elevational view of the adjustment mechanism of this invention operatively connected to a wire tensioning apparatus with some parts removed and others broken away for clarity of the illustration with the cams of the tension adjustment mechanism shown in a first position of rotation.

FIG. 1 of the drawings of this specification show a wire tensioning adjustment mechanism 11 mounted on a wire tensioning apparatus 13 of the type shown and described in the aforementioned U.S. Pat. No. 3,837,598 which mechanism has been modified as hereinafter described to accommodate the new wire tensioning adjustment mechanism 11. The adjustment nut and U-shaped member shown in said U.S. Pat. No. 3,837,598 which were used as described therein to vary the bias applied to the brake operating arm 15 through spring 17 has been replaced in this invention by a slidable adjustment rod 19 which can be moved relative to the wire tensioning apparatus 13 to vary the bias applied to the brake operating arm 15.

The wire tensioning adjustment mechanism 11 includes a leg 21 which is clamped between a support bracket 23 and the wire tensioning apparatus 13. The leg 21 is formed integrally with a U-shaped clevis 25 having a base 27 and end walls 29 and 31 extending from the base 27. The adjustment rod 19 extends through an opening, not shown, in the base 27 of the clevis 25.

A mounting plate 33 is attached to end wall 29 of the clevis 25 and a mounting plate 35 is attached to the end wall 31 of the clevis. A wiring board 37 is attached to the outer side of the mounting plate 33. A side wall 39 is attached to the mounting plates 33 and 35 and a second side wall fits on the opposite side of the clevis 25 from the side wall 39 but is not shown for clarity of illustration.

A cam shaft assembly 41 including a cam shaft 43 (FIGS. 5 and 6) is mounted on the end walls 29 and 31 of the clevis 25. A portion 45 of the cam shaft 43 is square in cross-section as is shown most clearly in FIGS. 1, 5 and 6 of the drawings. An output shaft 47 from a reduction gear mechanism 49 connects to one end of the cam shaft with the reduction gear mechanism driven by an electric drive motor 51. The electric drive motor and reduction gear are mounted on the mounting plate 33. The reduction gear mechanism 49 provides an output of 20 revolutions per minute. The electric motor 51 is supplied with power from wires shown schematically at 53, which wires extend into the wiring board 37. The wiring board is connected to a power supply cord 55 leading to a switch housing 57 which contains an on/off switch 59 and a receptacle plug 61. All of the wiring elements are shown diagrammatically because they are conventional electrical devices.

In place of the on/off switch 59, the electric motor 51 may have its power supply controller by a software program computer to move the cams to their operative positions and thus adjust the tension to the values desired. Another modification of the power supply is to use a timing circuit to permit current flow to the electric motor 51 for a predetermined interval of time after the on/off switch 59 is deactivated to enable the cams to index to their next positions.

Four cams 71, 73, 75 and 77 are mounted on the square cross-sectional portion 45 of the cam shaft 43 as can be seen in the figures of the drawings with the cams spaced part along the length of the cam shaft. As can best be seen in FIG. 1 of the drawings, each of the cams has a square passage 79 extending therethrough which passage is sized to closely engage the square portion 45 of the cam shaft 43. Each of the cams is located circumferentially 90 degrees relative to the others with the cam lobes extending outwardly at zero, 90, 180 and 270 degrees relative to the cam shaft 43.

Figure 5:
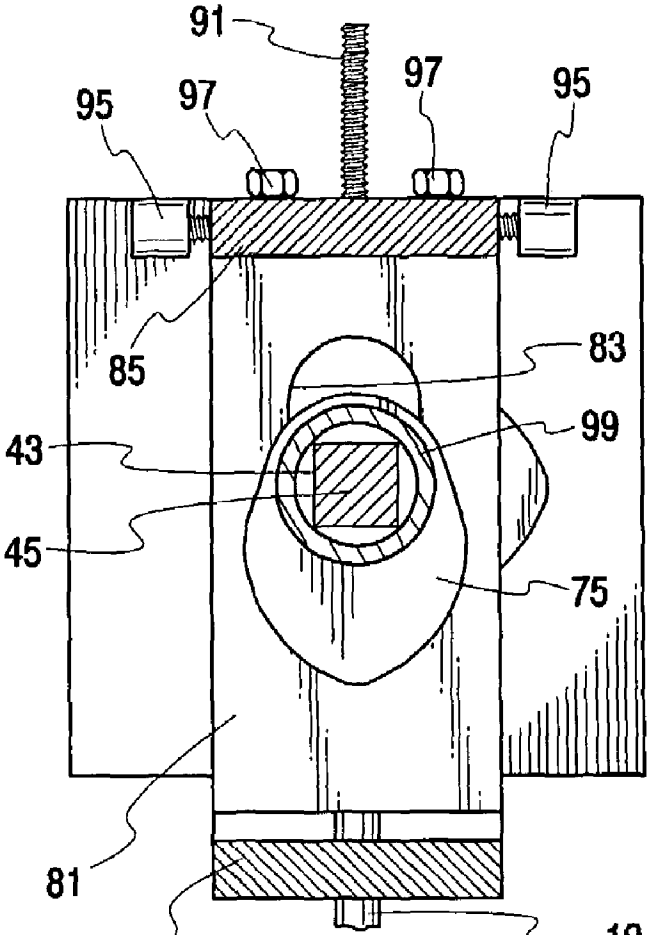
FIG. 5 is an enlarged, cross sectional view taken along line 5-5 of FIG. 1.

As shown generally in FIGS. 1-4 and in enlarged detail in FIG. 5 of the drawings, a guide plate 81 is connected to the slidable adjustment rod 19 inside the U-shaped clevis 25. The guide plate is formed with an elongated vertically extending slot 83 through which receives the cam shaft 43 as shown in FIG. 5 to permit the guide plate to move freely relative to the cam shaft 43. The guide plate 81 carries a cam follower plate 85. Cam followers 87, 89, 91 and 93 in the form of threaded rods are spaced apart along the length of the cam follower plate 85 with each threaded rod extending through a threaded passage, not shown, in the cam follower plate and aligned with one of the cams 71, 73, 75 and 77. The threaded rods can be rotated to move upwardly and downwardly relative to the cam follower support plate to engage or be moved out of engagement with the lobe of its respective cam. A plastic locking cap screw 95 is provided for each threaded rod cam follower to secure the threaded rod in a selected position of vertical adjustment with three of the four of these locking screws 95 shown in the drawings. Cap screws 97 connect the cam follower plate 85 to the guide plate 81. Bushings 99, shown generally in FIGS. 1-4 and in detail in FIG. 5, fit over cam shaft 43 and maintain the proper spacing of the cams 71, 73, 75 and 77 along the cam shaft 43. The bushings are formed of a fully cured, solid composite of phenol-formaldahyde resin and a cloth laminate reinforcement sold under the trademark GAROLITE™ by McMaster-Carr Supply Company.

A pair of nylon washers 101 are positioned between cams 73 and 75 around the cam shaft 43 and are located in the elongated slot 83 of the guide plate 81 to assist in the vertical movement of the guide plate 81 relative to the cams. These washers are shown in the broken away portion of guide plate 81 in FIG. 2 of the drawings.

Figure 6:
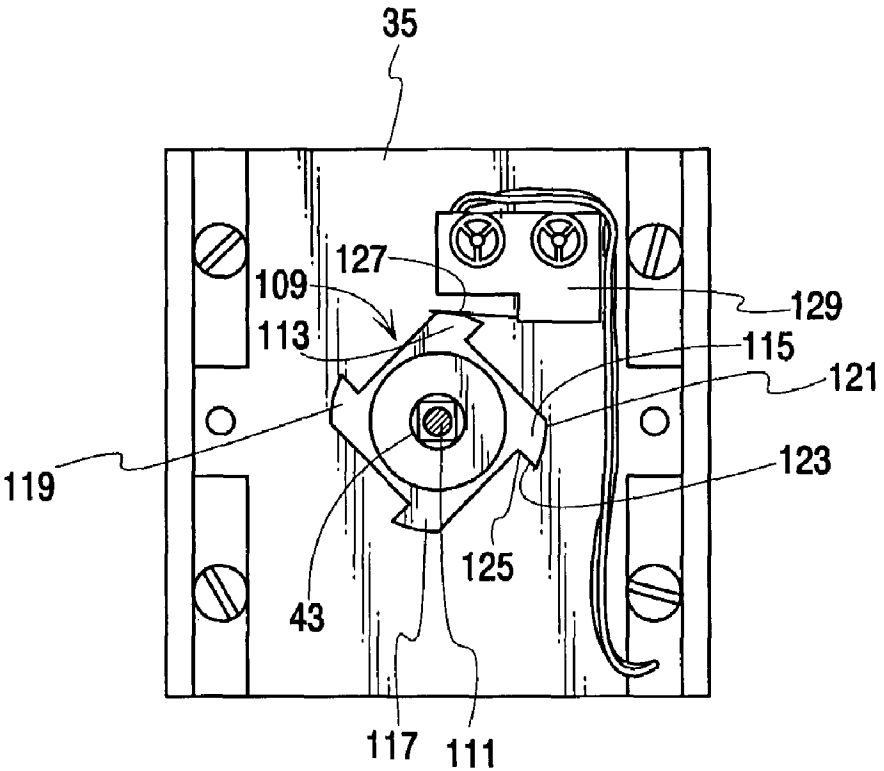
FIG. 6 is an enlarged view taken along line 6-6 of FIG. 1.

Located at the end of the cam shaft 43 remote from the electric drive motor 51 and outside of the mounting plate 35 is a four mode switch cam 109 attached to a hub 111 at the end of the cam shaft 43. As can best be seen in FIG. 6 of the drawings, the cam 109 has four lobes 113, 115, 117 and 119 each of which is aligned with a lobe of one of the cams 71, 73, 75 and 77 of the cam shaft 43. Referring now to cam lobe 115 as typical, each of the lobes has a profile including a curved contact surface 121 at the peak of the lobe, a sharp drop off surface 123 and a flat valley surface 125. When the cam 109 is rotating in a counterclockwise direction as viewed in FIG. 6 of the drawings, the curved contact surface 121 of a lobe, for example, lobe 13, engages the arm 127 of a micro switch 129. The micro switch 129 is connected to the electrical wiring so it is in a normal circuit "on" position in parallel with the on/off switch 59 and is held in its "off" position by engagement with the curved contact surface 121 of the cam lobe. As the cam rotates in the counterclockwise direction as shown in FIG. 6, the arm 127 passes its engagement with the curved contact surface 121 and engages the sharp drop off surface 123. At this point, the switch 129 moves to the normally circuit "on" position and engages the flat valley 125 of the cam lobe keeping the switch in a normal circuit "on" condition until the next lobe 115 of the cam engages the arm 127 and moves the normally circuit "on" arm 127 to its circuit "off" position.

Figure 7:
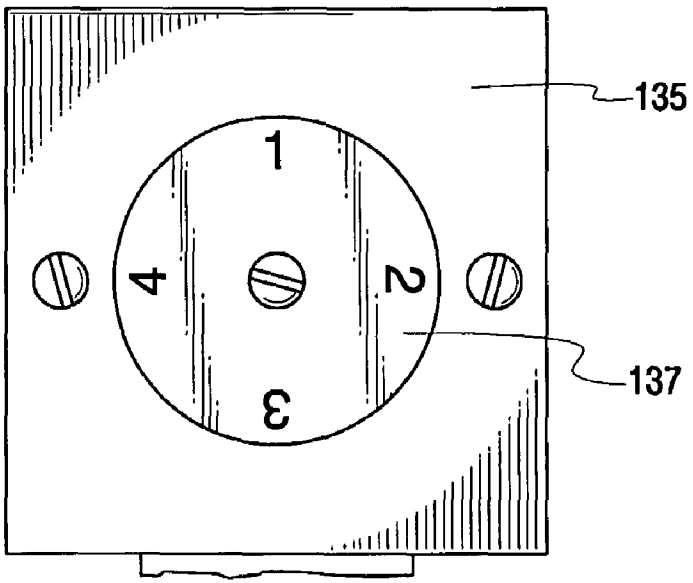
FIG. 7 is an enlarged end view taken along line 7-7 of FIG. 1.

As shown generally in FIGS. 1 to 4 and specifically in FIG. 7 of the drawings, a fiber panel 135 attaches to the end mounting plate 35. A tension indicator disk 137 is connected to the hub 111 outwardly of fiber panel 135. Numbers 1, 2, 3 and 4 are formed on the tension indicating disk and aligned with the cam lobes 113, 115, 117, 119 and the cams 71, 73, 75 and 77.

If four levels of tension are not required for a particular application, it is possible to modify the wire tensioning adjustment mechanism 11 to provide fewer levels of tension without modifying the cams mounted on the cam shaft assembly 41. This modification is accomplished by removing one or more of the lobes 113, 115, 117 and 119 of the four mode switch cam 109. For example if only two levels of tensioning are required, switch cam lobes 117 and 119 could be removed physically from the switch cam 109 or a two lobe switch cam could be provided. The removal or non-provision of two or the four switch cam lobes will not affect the operation of the cams of the cam shaft assembly 41 but continue to be used to adjust the tension. As the curved contact surface 121 of the second remaining switch cam lobe rotates past contact with the arm 127 of the micro switch 129, the arm 127 drops into what is effectively a continuation of a flat valley surface 125 and its micro switch 129 remains in its "on" position supplying current to the electric motor 51 thereby assuring that the cam shaft 43 and the cams are indexed to their next tensioning position.

The use, operation and function of this invention are as follows:

The wire tensioning adjustment mechanism 11 of this invention provides four levels of tension for the wire tensioning apparatus 13. The tension is increased from the first to the fourth levels with the levels designated by the numerals 1 to 4 depicted on the tension indicator disk 137 in FIG. 7. The levels of tension are established by the cams 71, 73, 75 and 77 acting with their respective threaded cam follower rods 87, 89, 91 and 93.

For ease and economy of manufacture of the wire tensioning adjustment mechanism, the cams 71, 73, 75 and 77 are identical and thus can be substituted for one another. The amount of vertical movement of the follower plate 85 relative to the clevis 25 and, therefore, the upward movement of the rod 19 which creates the tension on the spring 17 and the braking effect of the band brake is created by the engagement of a cam with its threaded cam follower rod.

The first position of tension shown in FIGS. 1, 5, 6 and 7 of the drawings is the position of minimum tension. The numeral 1 depicted on the tension disk indicator 137 is in the zero degree position of rotation. The threaded cam follower rod 87 extends only a distance equal to a few revolutions of the rod 87 below the bottom of the follower plate 85, if it extends below the bottom of the follower plate at all. An advantage of the adjustment mechanism 11 of this invention is that the amount of tension applied to the spring 17 in this position of rotation of the cam shaft 43, as well as in all other positions of rotation, can be further adjusted by vertical movement of the threaded cam follower rod 87 into and out of contact with the lobe of the cam 71. Note that in the first position of rotation, all of the other cams 73, 75 and 77 are in positions of rotation out of engagement with their respective cam follower rods and any adjustment of the cam follower rod 87 relative to its aligned cam 71 will not affect the other cams or the spring tension created by them.

Figure 2:
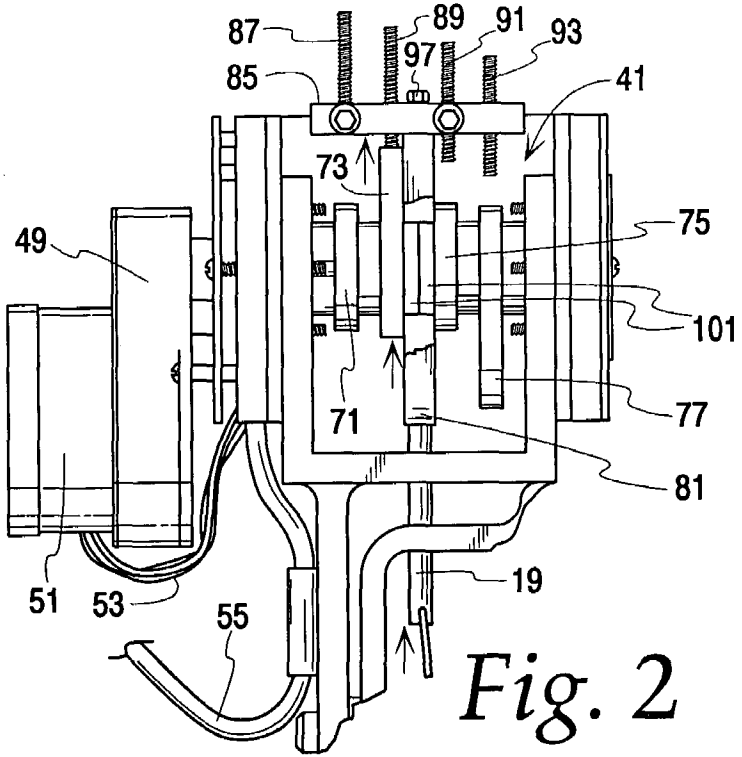
FIG. 2 is a partial side elevational view of the adjustment mechanism of FIG. 1 with some parts broken away and the cams of the tension adjustment mechanism shown in a second position of rotation.

The second position of adjustment of the tension applied to the spring 17 is shown in FIG. 2 of the drawings in which the cam 73 engages its cam follower rod 89 which has been rotatably adjusted to extend below the bottom of the cam follower plate 85 to engage the lobe of the cam 73. This change of adjustment of the tension applied to the spring 17 is accomplished by actuating the on/off switch 59 of the switch housing 57. Actuation of the switch 59 rotates the cam shaft 43 in a counter clockwise direction through an arc of 90° as viewed in FIGS. 5, 6 and 7 of the drawings to move cam 71 out of engagement with its cam follower rod 87 and to move cam 73 into engagement with its cam follower rod 89 thereby lifting the cam follower plate 85 relative to its previous position because the cam follower rod 89 extends lower than the rod 87 and thereby increasing tension on the spring 17.

Figure 3:
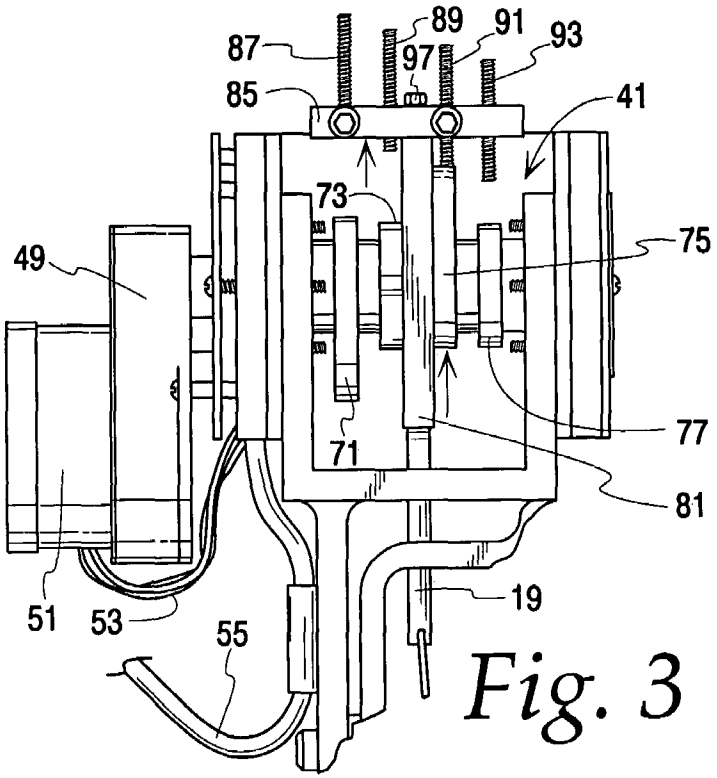
FIG. 3 is a view similar to the view of FIG. 2 and showing the cams of the tension adjustment mechanism in a third position of rotation.

The third position of adjustment of the tension applied to the spring 17 is shown in FIG. 3 of the drawings wherein the cam 75 engages its cam follower rod 91 which has been rotatably adjusted to extend below the bottom of the cam follower 85 a greater distance than either the cam follower rods 89 or 87. This position is reached by actuation of the on/off switch 59 of the switch housing 57 in the manner previously described to rotate the cam shaft another 90°.

Figure 4:
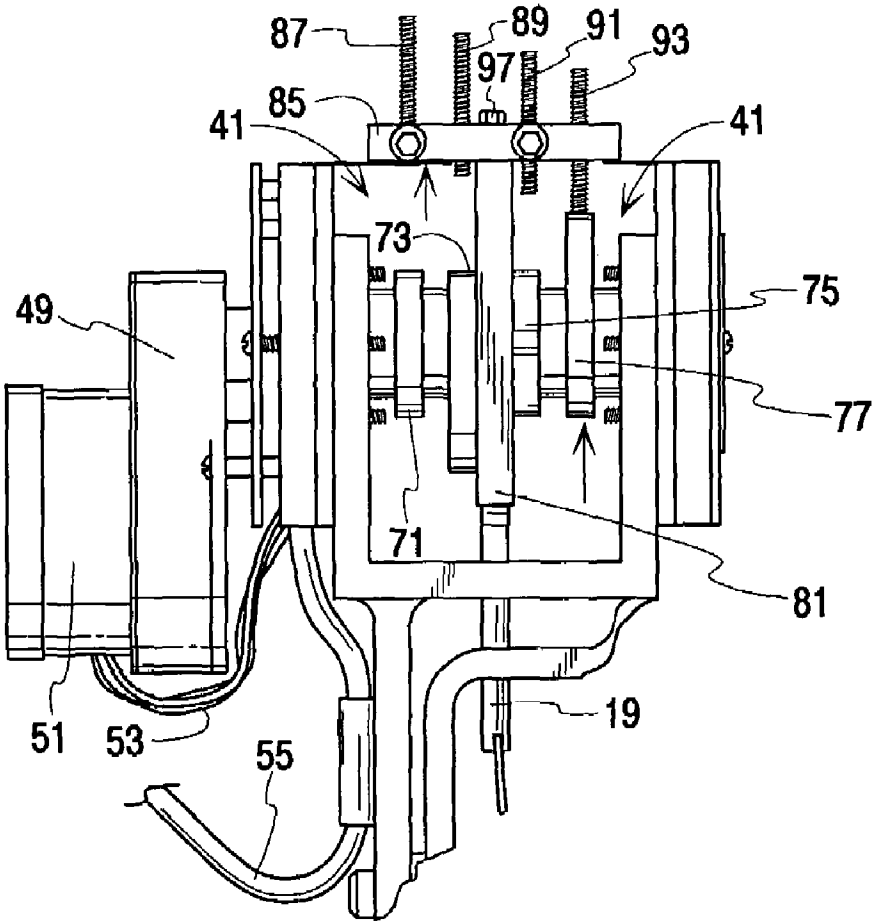
FIG. 4 is a view similar to the view of FIG. 2 and showing the cams of the tension adjustment mechanism in a fourth position of rotation.

The fourth position of adjustment of the tension applied to the spring 17 is shown in FIG. 4 of the drawings wherein the cam 77 engages its cam follower rod 93 which has been rotatably adjusted to extend below the bottom of the cam follower plate 85 a greater distance than any of the cam follower rods 91, 89 or 87. This described arrangement of the cam follower rods increasing in their extension below the bottom of the cam follower plate 85 from the follower rod 87 of the first position of adjustment to the follower rod 93 of the fourth position of adjustment provides a stepped increase in tension applied to the spring 17.

In each of the four positions of tension which can be achieved by rotating the cam shaft 43 to a position indicated by the numerals 1, 2, 3 and 4 on the tension indicator disk 137, the actual tension can be adjusted by rotating the cam follower rods, 87, 89, 91 or 93. Once adjusted to a selected position of rotation, the cam follower rods can be secured in their desired positions by tightening the respective plastic locking cap screws 95. Thus, the provision of adjustable cam follower rods 87, 89, 91 and 93 permits a broad range of adjustment of the tension applied to the spring 17 when using cams 71, 73, 75 and 77 of the same size.

The invention claimed is:

1. An adjustment mechanism for a wire tensioning apparatus in which tension is varied by linear movement of an adjustment rod, said adjustment mechanism including:

a cam shaft having a plurality of cams each offset relative to one another along said cam shaft, a guide plate attached to said adjustment rod and slidable relative to said cam shaft, a cam follower support associated with said guide plate, a plurality of cam followers mounted on said follower support with one cam follower for each cam on said cam shaft, each cam follower aligned with one of said cams and engageable with said one of said cams, and means to rotate said cam shaft to sequentially move one of said cams into engagement with its cam follower to move said adjustment rod while rotating the remainder of said plurality of cams out of engagement with their respective cam followers.

2. An adjustment mechanism for a wire tensioning apparatus of the type in which tension on the wire is varied by linear movement of an adjustment rod, said mechanism including:

a cam shaft having a plurality of cams mounted on said cam shaft along the length of said cam shaft, each cam having a lobe with said lobes of said cams positioned circumferentially around said cam shaft relative to one another, a guide plate attached to said adjustment rod with said guide plate slidable relative to said cam shaft, a cam follower plate mounted on said guide plate, a plurality of cam followers carried by said cam follower plate with one cam follower for each said cam on said cam shaft and having each cam follower aligned with one of said cams and engageable with said one of said cams, and means to rotate said cam shaft to sequentially move one of said cams into engagement with its cam follower to move said adjustment rod while rotating the remainder of said plurality of cams out of engagement with their respective cam followers.

3. The adjustment mechanism of claim 2 in which said cam lobes are positioned 90 degrees circumferentially relative to each other around said cam shaft.

4. The adjustment mechanism of claim 2 in which each of said cam followers is individually adjustable for movement towards and away from its cam.

5. The adjustment mechanism of claim 4 in which each of said individually adjustable cam followers is an elongated screw.

6. The adjustment mechanism of claim 5 in which each of said individually adjustable elongated screw cam followers extends through said cam follower plate with one end of each of said elongated screws positioned on one side of said cam follower plate where it is engageable with the lobe of its said cam and another end of each of said elongated screws is positioned on the opposite side of said cam follower plate where it is accessible for adjustment.

7. The adjustment mechanism of claim 2 in which guide plate straddles said cam shaft.

8. The adjustment mechanism of claim 2 in which said means to rotate said cam shaft includes an electric motor and reduction gearing connected to said cam shaft to rotate said shaft in only one direction of rotation.

9. The adjustment mechanism of claim 8 in which a manual switch controls current to said electric motor, a normally "on" micro switch supplies current in parallel with said manual switch to said electric motor, an indexing cam is mounted on said cam shaft, said indexing cam includes a plurality of indexing lobes with each indexing lobe aligned with one of said cam shaft lobes, each of said indexing lobes being engageable with said micro switch upon rotation of said cam shaft to maintain said micro switch in an "off" condition, each of said indexing lobes having a profile formed to actuate said micro switch to its normally "on" position upon rotation of said indexing cam brought about by actuation of said manual switch to move the cam shaft to the next index lobe when said manual switch is deactivated.

10. An adjustment mechanism for a wire tensioning apparatus in which tension is varied by linear movement of an adjustment rod, said adjustment mechanism comprises:

a cam shaft having a plurality of cams mounted on said cam shaft with said cams spaced from one another along the length of said cam shaft, each cam having a lobe of equal length with said lobes of said cams positioned circumferentially around said cam shaft relative to one another, a guide plate attached to said adjustment rod with said guide plate slidable relative to said cam shaft, an elongated follower plate connected to said guide plate and spanning said cams, a plurality of cam followers carried by said cam follower plate with each cam follower aligned with and engageable with one of said cams, and means to rotate said cam shaft to sequentially rotate one of said lobes of one of said cams into engagement with its aligned cam follower to move said adjustment rod while rotating said lobes of said remaining cams of said plurality of cams out of engagement with each of their respective cam followers.

11. The adjustment mechanism of claim 10 in which said cam shaft rotates in only one direction of rotation, an indexing cam is mounted on said earn shaft, said indexing cam includes a plurality of indexing lobes with each indexing lobe aligned with one of said cam shaft lobes, each of said indexing lobes being sequentially engageabie with an electric switch which controls electric current to an electric motor rotating said shaft, and manual switch means to activate said electric motor to momentarily rotate said cam shaft to move one of said indexing lobes out of and another of said indexing lobes into engagement with said electric switch.

12. The adjustment mechanism of claim 10 in which said cam lobes are positioned 90 degrees circumferentially relative to each other around said shaft.

13. The adjustment mechanism of claim 10 in which each of said cam followers is individually adjustable for movement towards and away from its cam.

14. The adjustment mechanism of claim 10 in which each of said individually adjustable cam followers is an elongated screw.

15. The adjustment mechanism of claim 14 in which each of said individually adjustable elongated screw cam followers extends through said cam follower plate with one end of each of said elongated screws positioned on one side of said cam follower plate where it is engageable with the lobe of its said cam and another end of each of said elongated screws is positioned on the opposite, side of said cam follower plate where it is accessible for adjustment.

* * * * *